United States Patent [19]

Andrianjafy

[11] 4,106,314

[45] Aug. 15, 1978

[54] APPARATUS FOR DYEING, OPTIONALLY FIXING AND ELUTING A DYEABLE SUBSTRATE

[75] Inventor: Gabriel Rostanol Andrianjafy, Hatton, England

[73] Assignee: B.S.G. Designs, Inc., England

[21] Appl. No.: 810,742

[22] Filed: Jun. 28, 1977

[51] Int. Cl.[2] ..... D06B 1/14; D06B 11/00; D06B 15/02

[52] U.S. Cl. ..... 68/22 R; 68/19.1; 68/20; 68/202

[58] Field of Search ..... 68/22 R, 13 R, 19.1, 68/20, 200, 202, 203

[56] References Cited

U.S. PATENT DOCUMENTS

| | | | |
|---|---|---|---|
| 2,293,154 | 8/1942 | Lovett | 68/22 R X |
| 2,419,695 | 4/1947 | Shuttleworth et al. | 68/202 X |
| 2,737,042 | 3/1956 | Mathewson et al. | 68/202 |

FOREIGN PATENT DOCUMENTS

| | | | |
|---|---|---|---|
| 2,457,781 | 6/1975 | Fed. Rep. of Germany | 68/202 |
| 1,197,180 | 7/1970 | United Kingdom | 68/202 |

*Primary Examiner*—Philip R. Coe
*Attorney, Agent, or Firm*—Larson, Taylor and Hinds

[57] ABSTRACT

An apparatus for dyeing, fixing and eluting a dyeable substrate is provided. The apparatus comprises a take-up roller for receiving the dyeable substrate; roller means, including a driven roller, for receiving the substrate from said take-up roller and for orienting the substrate in a generally horizontal plane; and a dyeing assembly including a plurality of dye containers, a like plurality of discs being mounted on a first rotatable shaft so that, for each disc, one edge thereof dips into the container so as to take dye therefrom, the opposite edge of each of said discs engaging the substrate. The apparatus also includes an idler roller assembly for receiving the substrate after the substrate passes through the dyeing assembly; a further roller, mounted a substantial distance above the working plane of said apparatus, over which the substrate is entrained; a further idler roller assembly, for receiving the substrate after the substrate passes over said further roller; and an eluting assembly similar to the dyeing assembly; pinch roller means; and take-off roller for receiving the substrate from the pinch roller means. A plurality of dye storage tanks mounted on the apparatus provide for selectively gravity feeding dye to said dye containers while an eluant storage tank provides for feeding eluant to corresponding eluant containers.

8 Claims, 5 Drawing Figures

FIG. 2
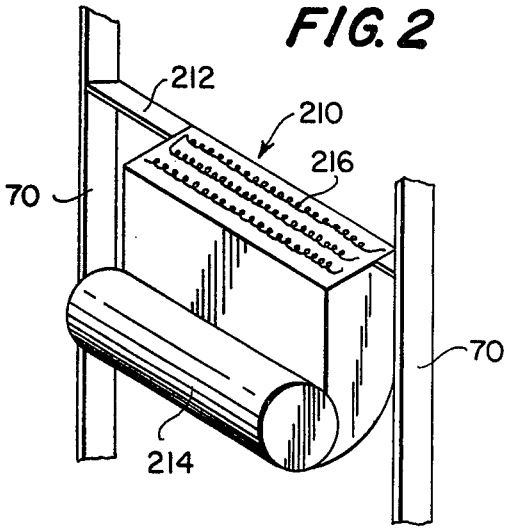
FIG. 4
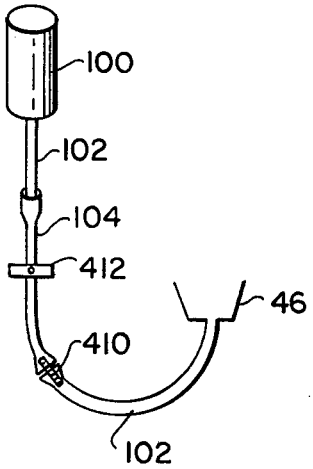
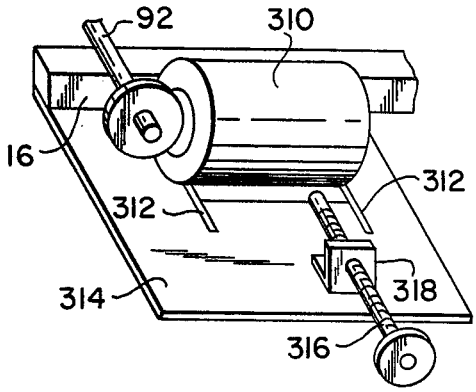
FIG. 3
FIG. 5
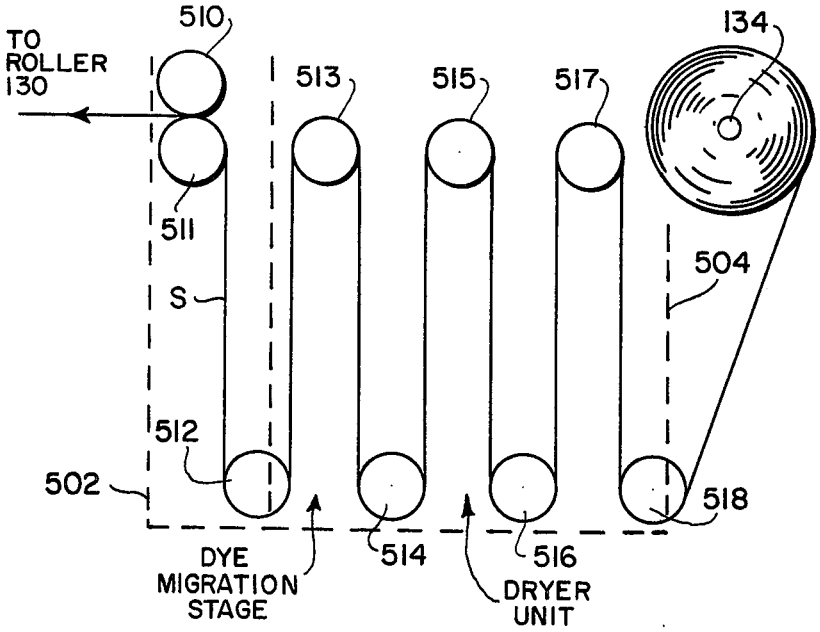

APPARATUS FOR DYEING, OPTIONALLY FIXING AND ELUTING A DYEABLE SUBSTRATE

FIELD OF THE INVENTION

The present invention relates to an apparatus for dyeing, fixing and eluting a dyeable substrate.

BACKGROUND OF THE INVENTION

In commonly assigned application Ser. No. 531,390 (Newton), now U.S. Pat. No. 4,000,964, issued on Jan. 4, 1977, there is disclosed a method and apparatus for effecting coloration of a dyeable substrate by using an eluant, as described hereinbelow, to modify the appearance of an unfixed dyestuff in the substrate. In general, the dyestuff is applied and, prior to fixation, eluant is applied to modify the appearance of the dyestuff, the dyestuff then being fixed or allowed to fix. In certain embodiments, the dyestuff initially applied comprises a mixture of two dye liquors of different colors and having different fixation properties, so as to form an area of color. One dye may then be caused or allowed to undergo fixation, without fixation of the other. An eluant is then applied to displace the unfixed dye wholly or partly out of the area. Consequently, the area in question attains or nearly attains the color of the first dye and the area of the substrate around the first-mentioned area attains or nearly attains the color of the second dye. The second dye may then be caused or allowed to undergo fixation.

A divisional application based on the above-mentioned Newton application, namely, U.S. application Ser. No. 660,223, filed on Feb. 23, 1976, concerns the apparatus used in applying the dye and eluant. The disclosures of both applications are hereby incorporated by reference.

SUMMARY OF THE INVENTION

The present invention concerns an apparatus for carrying out the methods of the Newton patent in an optimum manner on a commercial basis.

In accordance with a preferred embodiment an apparatus for dyeing, optionally fixing and eluting a dyeable substrate is provided which comprises a take-up roller for receiving the dyeable substrate; roller means, including a driven roller, for receiving the substrate from said take-up roller and for orienting the substrate in a generally horizontal plane; and a dyeable assembly including a plurality of dye containers, and a like plurality of discs mounted on a first rotatable shaft so that, for each disc, one edge thereof dips into the container so as to pick up dye therefrom, the opposite edge of each of said discs engaging the substrate. The dyeing assembly generally corresponds to that disclosed in the Newton applications referred to above. The apparatus further comprises an idler roller assembly for receiving the substrate after the substrate passes through the dyeing assembly and a further roller, mounted a substantial distance above the working plane of said apparatus, over which the substrate is entrained. This latter arrangement can be used to provide fixing of one of the dyes in plural dye embodiments such as discussed above and, if required, a heat source can be added for this purpose. The apparatus also includes a further idler roller assembly, for receiving said substrate after said substrate passes over said further roller and an eluting assembly including a plurality of eluant container, and a like plurality of discs mounted on a second rotatable shaft so that, for each disc, one edge dips into the containers so as to pick up eluant therefrom, the opposite edge of each of said discs engaging the substrate. The eluting assembly is similar to the dyeing assembly.

A pinch roller means, including a driven roller, is located downstream of the eluting assembly, for receiving the substrate from said eluting assembly and pinching the substrate therebetween.

A take-off roller receives the substrate from said pinch roller means. The apparatus also includes a plurality of dye storage tanks mounted on the apparatus for selectively gravity feeding dye to the dye containers and means, including an eluant storage tank mounted on the apparatus, for feeding eluant to said eluant containers in a like manner.

Finally, first and second separate drive motor means selectively drive said first and second shafts at variable speeds to control the dyeing and eluting operations.

Preferably, the apparatus also comprises further electric motor means for driving the driven roller of the roller means and the driven roller of the pinch roller means.

Advantageously, the roller means further includes an idler roller and the pinch roller means further includes an idler roller, and the apparatus further comprises a main frame assembly for supporting the idler roller of said roller means, the first shaft, the first idler roller assembly, the second idler roller assembly, the second shaft, and the idler roller of said pinch roller means. The further roller is supported by a vertically extending upright frame construction mounted on said main frame assembly, and the take-up and take-off rollers are respectively mounted on oppositely extending U-shaped frames mounted on an opposite ends of the main frame assembly. The roller means preferably includes an idler roller and the pinch roller means includes an idler roller, and both of the idler rollers are mounted on a support plane located beneath said main frame assembly. The driven roller of the roller means and the driven roller of the pinch roller means are interconnected by pulley means. Also, the electric motor means each preferably comprise a D.C. electric motor and an individual rheostat controls that motor.

Other features and advantages of the invention will be set forth in, or apparent from, the detailed description of a preferred embodiment found hereinbelow.

BRIEF DESCRIPTION OF THE DRAWINGS

FIG. 2 is a perspective view of a heater unit adapted to be used in the embodiment of FIG. 1;

FIG. 3 is a perspective view of an alternative embodiment of the drive motor for the eluting apparatus shown in FIG. 1;

FIG. 4 is a diagrammatic side elvational view of a detail of the apparatus of FIG. 1; and FIG. 5 is a diagrammatic side elevation view of a modification of the apparatus of FIG. 1.

DESCRIPTION OF THE PREFERRED EMBODIMENT

Figure 1:
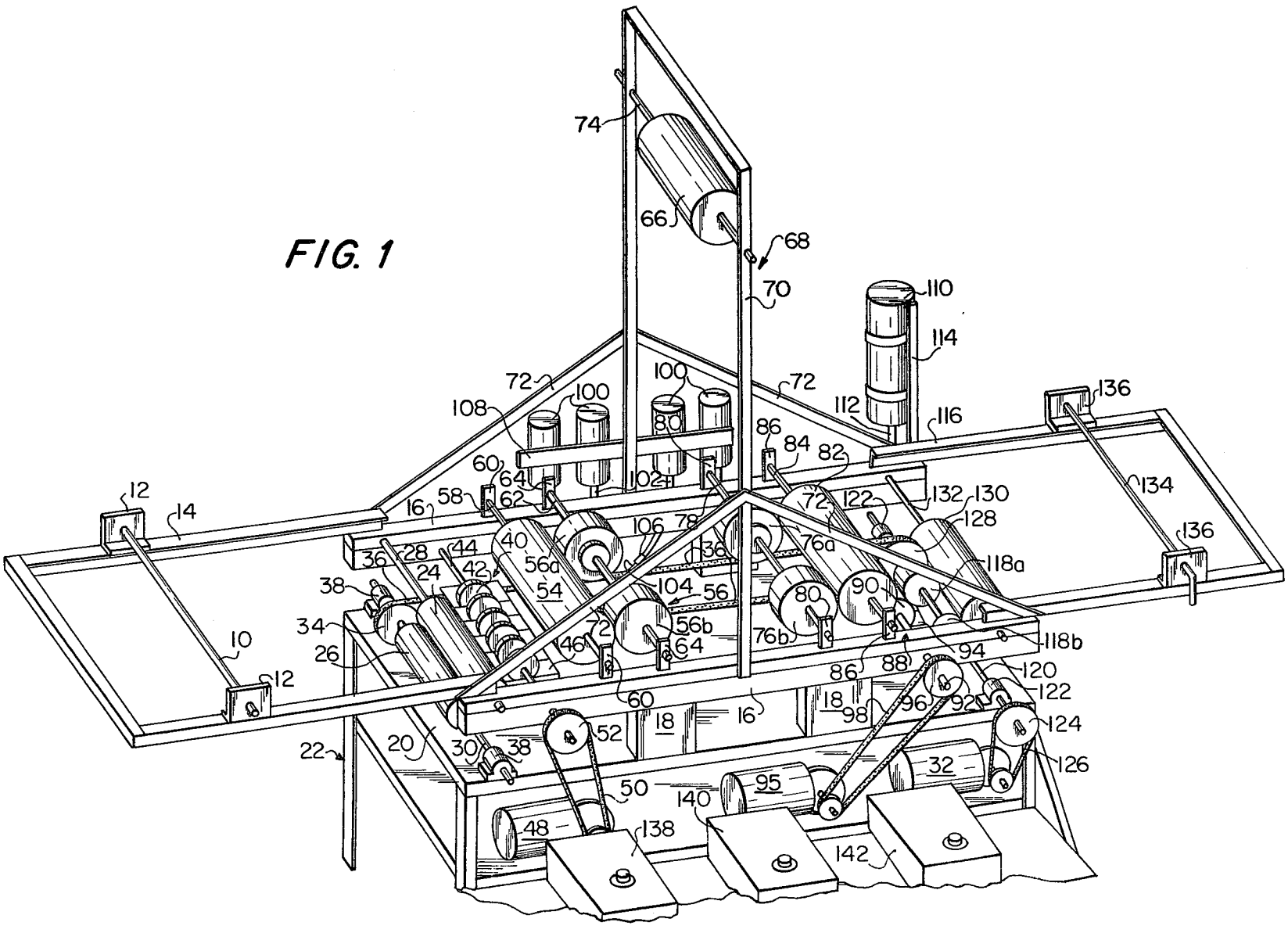
FIG. 1 is a perspective view of a preferred embodiment of an apparatus for dyeing, fixing and eluting a substrate, in accordance with the invention.

Referring to the drawings, the dyeing apparatus of the invention includes an input or take-off roller 10 mounted on brackets 12 located on opposite sides of a generally U-shaped frame member 14. It is to be understood that with appropriate adjustments, the dyeable substrate can be fed from either end of the illustrated apparatus and thus that the end including roller 10 has been selected arbitrarily as the input end for purposes of discussion.

Frame 14 is mounted on a pair of main frame members 16 which, in turn, are supported by upright pedestals 18 (two of which are illustrated) on a planar support member 20. Support member 20 is itself supported by an open frame construction indicated at 22.

First and second pinch rollers 24 and 26 are disposed in the path of the dyeable substrate and serve to pinch the substrate therebetween. The first, upper roller 24 is an idler roller fixedly mounted on a shaft 28 journalled for rotation in main frame members 16. The second, lower roller 26 is a drive roller which is fixedly mounted on a shaft 30 driven by a first electric motor 32 through a pulley and belt system described in more detail hereinbelow. A pulley member 34 is fixedly mounted on shaft 30 and is driven by a belt 36. Shaft 30 is journalled for rotation in a pair of spaced bearing assemblies 38 located on support member 20.

A dyeing assembly 40 is located upstream of rollers 24 and 26 which generally corresponds to that disclosed in copending application Ser. No. 531,390, and includes a plurality of rotatable discs 42 fixedly mounted in spaced relation on a shaft 44 and including milled edges. Shaft 44 is journalled for rotation in main frame members 16. A container construction comprising a like plurality of individual containers 46 for dye liquor is located beneath discs 42 on support member 20 such that the lower portions of each of the discs 42 dip into the corresponding containers 46 to pick up dye liquor. Shaft 44 is driven by a second electric motor 48 through a pulley system including a V-belt 50 and a pulley member 42 mounted on shaft 44.

After leaving dyeing assembly 40, the dyeable substrate passes to and between a pair of free-wheeling rollers 54 and 56. Roller 54 is mounted on a shaft 58 between upright brackets 60 located on main support members 16. Roller 56 actually comprises first and second rollers **56*a* and 56*b* mounted on a shaft 62 between frame-mounted brackets 64**.

A further roller 66 is mounted by a frame construction 68 a substantial distance above the working plane of the remainder of the apparatus. The frame construction 68 includes an inverted U-shaped frame 70 and supporting struts 72 and roller 66 is is fixedly mounted on a shaft 74 between the sides of frame 70. With this arrangement, the substrate is compelled to travel vertically upwardly over roller 66 and down the other side thereof and heat may be applied by a suitable heater unit (not shown in FIG. 1 for purposes of clarity, but illustrated in FIG. 2) so as to fix the more reactive dyes on the substrate. The heater unit, which is denoted 210 in FIG. 2, is preferably mounted between the frame members 70 beneath roller 66 by a support member 212. The unit 210 is of conventional construction and includes a blower section 214 and heater coils 216.

A further free-whelling roller assembly is located on the other side of roller 66 which is similar to that just described. This assembly includes a pair of rollers **76*a* and 76*b* mounted on a shaft 78 supported by brackets 80 and a roller 82 mounted on a shaft 84 by brackets 86**. The roller assembly just described causes the substrate to travel in a generally horizontal plane.

An eluting assembly 88 is disposed downstream of rollers **76*a*, 76*b* and roller 82. Although only a portion of eluting assembly 88 can be seen in the drawings, the assembly is very similar to dyeing assembly 40 described hereinabove (and thus further illustration is not seen to be necessary), and includes a plurality of rotatable discs 90 fixedly mounted in spaced relation along a shaft 92. A container construction comprising a like plurality of individual eluant-containing containers 94 is disposed beneath discs 90 on support member 20 such that the discs 90 dip into the corresponding containers 94** to pick up the eluant. Before proceeding, it should be noted that, as is explained in co-pending application Ser. No. 660,22, the term "eluant" is taken from chromatography wherein it is used to denote a solvent for washing out material deposited on an absorbent material such as paper, silica gel or clay. As used herein, and in the application referred to, the term does not have an exact meaning but the function of the liquids described herein as "eluants" is analagous to that of eluants used in chromatography and is basically a displacement function.

Similarly to the dyeing assembly 40 described above, shaft 92 is driven by a third electric motor 95 through pulley arrangement including a pulley member 96 mounted on shaft 92 and a V-belt 98. In an alternative embodiment illustrated in FIG. 3, a direct drive is provided for shaft 92 by a D.C. motor 310. Motor 310 is supported on rails 312 disposed on a platform 314 which is, in turn, supported from a main frame member 16. Motor 310 is mounted on a threaded shaft 316 which is rotatable with respect to a bracket 318 on platform 314 so that the motor 310 can be moved slightly backwards or forwards to align discs 90 with the dyestuff on the substrate.

Both the dye containers 46 and the eluant containers 94 are filled by gravity. The dye containers 46 are filled from cylindrical reservoir tanks 100 mounted on one of the main frame members 16, as illustrated. A plastic tube 102 extends from the base of each reservoir tank 100 to the base of a corresponding container 46. A portion of the tubing, indicated at 104, is peristaltic tubing which enables the flow of dye from reservoir tanks 100 to be controlled by means of an associated clamp, indicated at 106. A connector, not shown in FIG. 1 but denoted 410 in FIG. 4, is preferably provided between the plastic tubing and the peristaltic tubing for purposes of draining and cleaning the containers 46. Referring to FIG. 4, which illustrates the tubing in more detail, the peristaltic tubing 104 is provided with a clamp 412 for controlling the flow of dye liquor. Although only four tanks 100 are shown, it would be understood that the number of reservoir tanks used can be the same as the number of containers 46 where the latter are all to contain dyes of a different color. A bracket 108 secured to frame member 70 is used to support tanks 100.

A further roller assembly is positioned downstream of eluting assembly 88 which provides pinching of the substrate. A first pair of rollers **118*a*, 118*b* are mounted for rotation on shaft 120 which is supported by bearing assemblies 112 on support member 20. Shaft 120 is driven through a pulley arrangement including pulley member 124 and V-belt 126 by motor 32 which was referred to hereinabove. Shaft 120 also supports a further pulley member 128 which drives belt 36 referred to perviously so as to cause rotation of roller 26. A second, free-wheeling roller 130 is fixedly mounted on a shaft 132 which is journalled for rotation between main frame members 16**.

A take-up roller 134 is positioned downstream of roller 130 to receive the dyed, fixed and eluted substrate. Roller 134 is mounted between brackets 136 on frame 116.

Motors 48, 95 and 32 are preferably 400 rpm D.C. motors. Controls in the form of rheostats 138, 140 and 142 are used to regulate the speeds of motors 48, 95 and 32, respectively and thus to control the speed of rotation of discs 42 and 96 as well as rollers 26 and 118*a*, 118*b*.

Referring to FIG. 5, an alternative embodiment of the invention is illustrated. In this embodiment, a dye migration stage, denoted 502, and a dyer unit, denoted 504, are disposed between roller 130 and take-up roller 134 of FIG. 1. A series of rollers 510 to 518 serve to pinch the substrate, denoted S, and to provide time for the dye to migrate by passing through a zig-zag path provided by the rollers 511, 512, 513 and 514 before entering the dryer unit 504. The latter can take any suitable conventional form.

Although the invention has been described relative to exemplary embodiments thereof, it will be understood that other variations and modifications can be effected in these embodiments without departing from the scope and spirit of the invention.

I claim:

1. An apparatus for dyeing, optionally fixing and eluting a dyeable substrate, said apparatus comprising:

a take-up roller for receiving the dyeable substrate;

roller means, including a driven roller, for receiving said substrate from said take-up roller and for orienting said substrate in a generally horizontal plane;

a dyeing assembly including a plurality of dye containers, a like plurality of discs mounted on a first rotatable shaft so that, for each disc, one edge thereof dips into the container so as to pick up dye therefrom, the opposite edge of each of said discs engaging the substrate;

an idler roller assembly for receiving the substrate after the substrate passes through the dyeing assembly;

a further roller, mounted a substantial distance above the working plane of said apparatus, over which said substrate is entrained;

a further idler roller assembly, for receiving said substrate after said substrate passes over said further roller;

an eluting assembly including a plurality of eluant containers, a like plurality of discs mounted on a second rotatable shaft so that, for each disc, one edge dips into the container so as to pick up eluant therefrom, the opposite edge of each of said discs engaging the substrate;

pinch roller means, including a driven roller, for receiving said substrate from said eluting assembly and pinching said substrate therebetween;

a take-off roller for receiving said substrate from said pinch roller means;

means including a plurality of dye storage tanks mounted on said apparatus for selectively gravity feeding dye to said dye containers;

means, including an eluant storage tank mounted on said apparatus, for feeding eluant to said eluant containers; and first and second separate drive motor means for selectively driving said first and second shafts at variable speeds.

2. An apparatus as claimed in claim 1 further comprising further electric motor means for driving said driven roller of said roller means and said driven roller of said pinch roller means.

3. An apparatus as claimed in claim 2 wherein said roller means further includes an idler roller and wherein said pinch roller means further includes an idler roller, said apparatus further comprising a main frame assembly for supporting said idler roller of said roller means, said first shaft, said first idler roller assembly, said second idler roller assembly, said second shaft and said idler roller of said pinch roller means.

4. An apparatus as claimed in claim 3 wherein said further roller is supported by a vertically extending upright frame construction mounted on said main frame assembly.

5. An apparatus as claimed in claim 3 wherein said take-up and take-off rollers are respectively mounted on oppositely extending U-shaped frames mounted on an opposite ends of said main frame assembly.

6. An apparatus as claimed in claim 3 wherein both of said idler rollers are mounted on a support plane located beneath said main frame assembly.

7. An apparatus as claimed in claim 2 wherein said driven roller of said roller means and said driven roller of said pinch roller means are interconnected by pulley means.

8. An apparatus as claimed in claim 2 wherein said electric motor means each include a D.C. electric motor and an individual rheostat control for said motor.

* * * * *